US006821236B2

(12) United States Patent
Liang

(10) Patent No.: US 6,821,236 B2
(45) Date of Patent: Nov. 23, 2004

(54) EXERCISER HAVING A SOLID DRIVING STRUCTURE

(76) Inventor: Shih Chuan Liang, P.O. Box 63-99, Taichung (TW), 406

( * ) Notice: Subject to any disclaimer, the term of this patent is extended or adjusted under 35 U.S.C. 154(b) by 409 days.

(21) Appl. No.: 10/060,265

(22) Filed: Feb. 1, 2002

(65) Prior Publication Data

US 2003/0148856 A1 Aug. 7, 2003

(51) Int. Cl.[7] ..... A63B 21/00
(52) U.S. Cl. ..... 482/138; 482/63; 482/114
(58) Field of Search ..... 482/1–9, 51, 57, 482/63, 64, 92, 110, 114, 115, 118, 900–902, 903, 139

(56) References Cited

U.S. PATENT DOCUMENTS 4,871,165 A * 10/1989 Marshall et al. ..... 482/116

* cited by examiner

*Primary Examiner*—Glenn E. Richman

(57) ABSTRACT

A exerciser includes a base having a hub for rotatably receiving a spindle which has a radially extended peripheral plate, a rotary member rotatably engaged onto the spindle, a unidirectional driving device having a frame engaged between the peripheral plate and the rotary member, and a pair of cranks coupled to the spindle for driving the rotary member unidirectionally with the driving device. The frame includes a bore for receiving the peripheral plate of the spindle, and having an inner diameter greater than the outer diameter of the spindle.

6 Claims, 6 Drawing Sheets

EXERCISER HAVING A SOLID DRIVING STRUCTURE

BACKGROUND OF THE INVENTION

1. Field of the Invention

The present invention relates to an exerciser and more particularly to an exerciser having a solid driving structure.

2. Description of the Prior Art

Typical exercisers, particularly the cycling exercisers comprise a pair of foot pedals coupled to a spindle with a sprocket-and-chain coupling mechanism or with a pulley-and-belt coupling device. The sprocket is normally rotatably secured to the hub of the cycle exerciser with a unidirectional bearing. However, the unidirectional bearing includes a relatively smaller outer diameter and will suffer a great transmission torque or force, such that the unidirectional bearing will normally be easily damaged after use.

The present invention has arisen to mitigate and/or obviate the afore-described disadvantages of the conventional exercisers.

SUMMARY OF THE INVENTION

The primary objective of the present invention is to provide an exerciser including a solid driving structure for allowing the sprocket or the pulley to be solidly and effectively driven by the spindle via the unidirectional bearing.

In accordance with one aspect of the invention, there is provided an exerciser comprising a base including a hub provided therein, a spindle rotatably retained in the hub of the base, and including a peripheral plate extended radially outward therefrom, a rotary member rotatably engaged onto the spindle, a unidirectional driving device including a frame engaged between the peripheral plate and the rotary member, and a pair of cranks coupled to the spindle for driving the rotary member unidirectionally with the unidirectional driving device.

The rotary member includes a casing secured in a middle portion thereof and having an outer peripheral portion, the rotary member includes a peripheral flange extended therefrom for engaging with the outer peripheral portion of the casing and for solidly securing the casing to the rotary member.

The casing includes a plurality of axially extended extension extended from the outer peripheral portion thereof for solidly engaging into the rotary member.

The frame of the unidirectional driving device includes a bore formed therein for receiving the peripheral plate of the spindle, and at least one channel formed therein and communicating with the bore of the frame and having a shallower end and a deeper end, a roller received in the at least one channel of the frame, and a spring biased projection engaged in the frame and engaged with the roller for biasing the roller toward the shallower end of the at least one channel of the frame and for allowing the roller to be clamped between the frame and the peripheral plate of the spindle.

A wheel is further provided and rotatably secured to the base with a shaft, and means for coupling the rotary member to the wheel.

The coupling means includes a first pulley provided on the wheel, the rotary member is a second pulley, and a belt engaged over the first pulley and the second pulley for allowing the wheel to be rotated and driven by the second pulley.

A device is further provided for magnetically retarding the wheel to retard and brake the wheel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
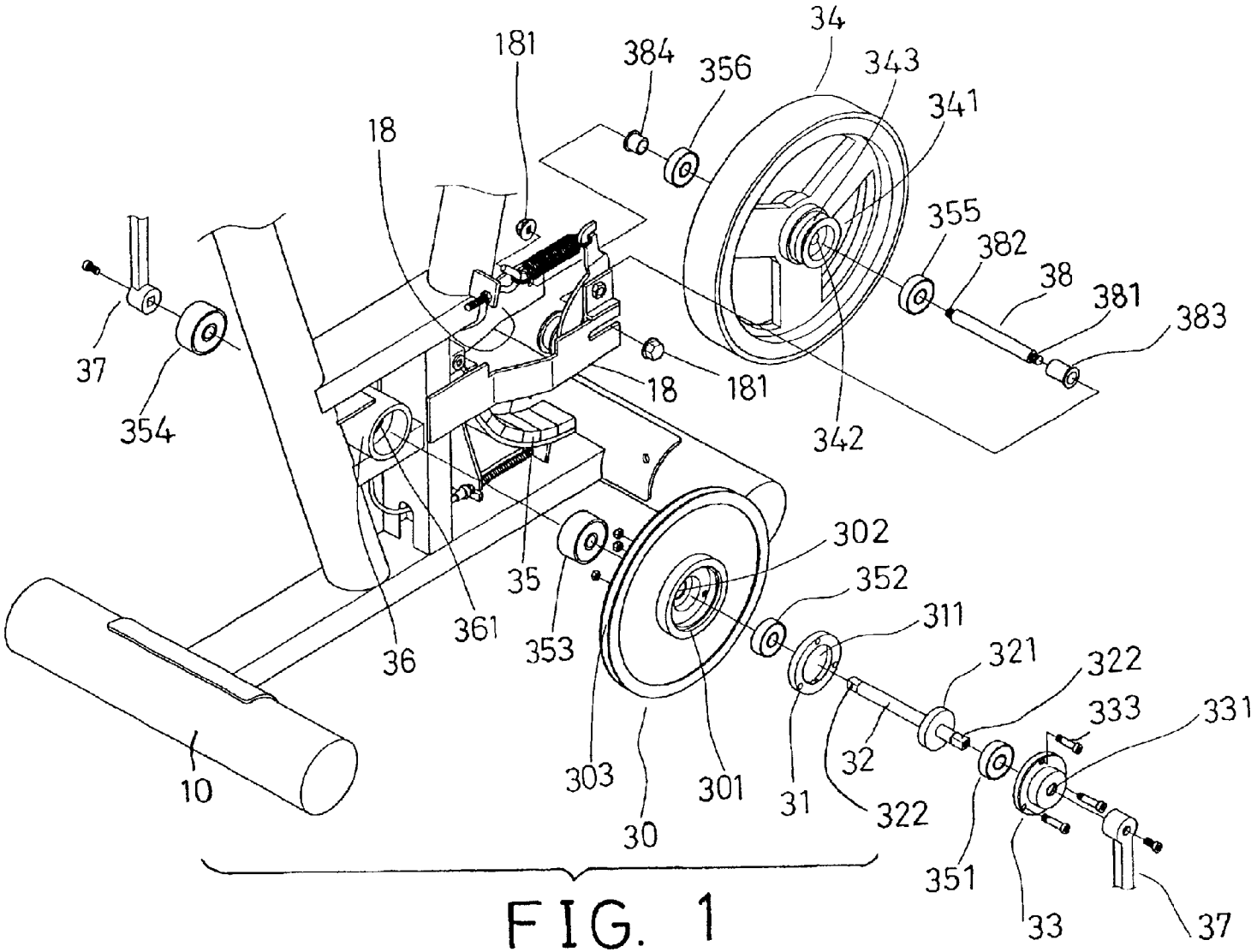
FIG. 1 is an exploded view of an exerciser in accordance with the present invention.

Referring to the drawings, and initially to FIGS. 1–5, an exerciser in accordance with the present invention comprises a base 10 including a hub 36 provided and disposed in the middle portion thereof and having an orifice 361 formed therein, and a pair of boards 18 secured to the middle or rear portion thereof. A weight or a wheel 34 is rotatably secured to the boards 18 of the base 10 with a shaft 38 and one or more bearings 355, 356. Two spacers 383, 384 are engaged between the wheel 34 and the boards 1, for solidly retaining the wheel 34 between the boards 18. The shaft 38 includes two ends each having an outer thread 381, 382 provided thereon for threading with the lock nuts 181 and for solidly securing the wheel 34 and the shaft 38 to the boards 18 of the base 10.

The base 10 may include such as a typical magnetic retarding or braking device 35 (FIG. 1) provided therein for engaging with the wheel 34 and for braking the wheel 34. The wheel 34 includes a hole 342 formed in the center thereof for receiving the shaft 38, and includes a rotary member or a or a pulley 341 provided or disposed or attached to one side thereof. The pulley 341 includes an outer peripheral portion having a peripheral recess 343 formed therein for receiving a chain or a belt 12. The pulley 341 and the belt 12 may be replaced with a sprocket-and-chain coupling mechanism.

A spindle 32 is rotatably received in the orifice 361 of the hub 36 with one or more bearings 353, 354, and includes an enlarged plate 321 extended radially outward therefrom, and includes two ends 322 each having a non-circular cross section, such as a square cross section. Another rotary member or a or pulley 30 is rotatably engaged onto the spindle 32 with one or more bearings 351, 352. The pulley 30 includes a bore 302 formed therein for receiving the spindle 32, and includes an outer peripheral portion having a peripheral recess 303 formed therein for receiving the chain or the belt 12. Similarly, the pulley 30 and the belt 12 and the pulley 341 may also be replaced with a sprocket-and-chain coupling mechanism.

Figure 4:
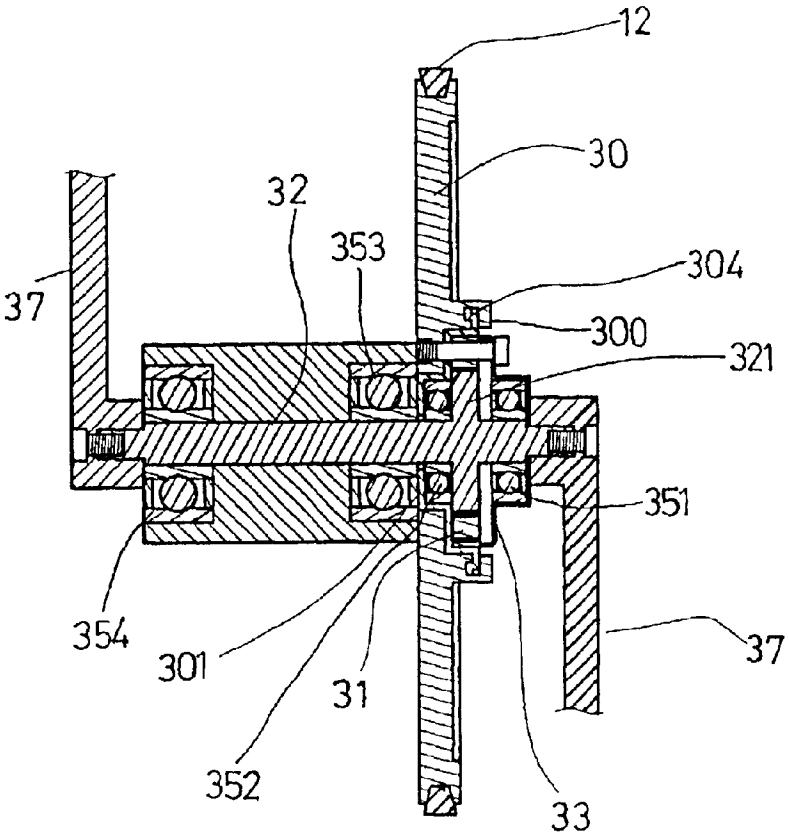
Figure 6:
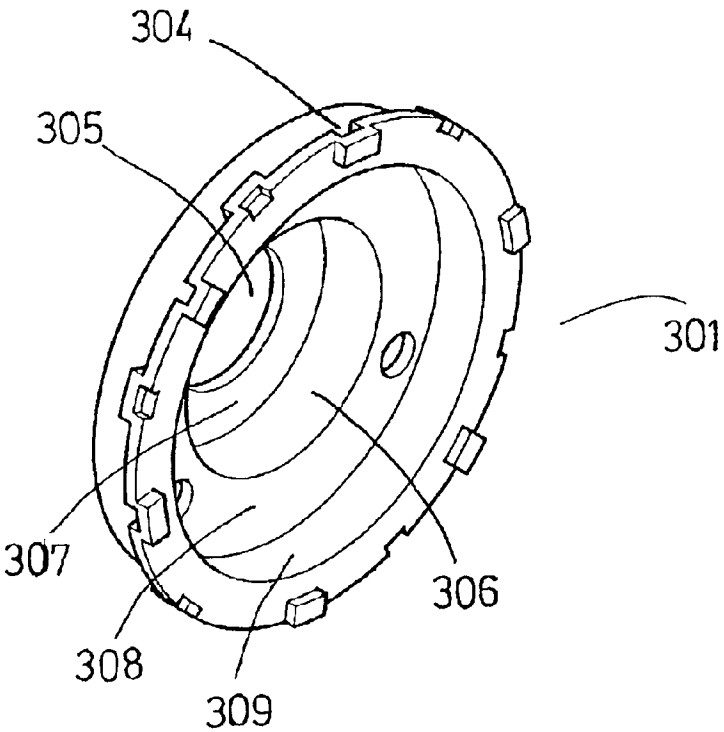
FIG. 6 is a perspective view showing a casing for the driving mechanism of the exerciser.
Figure 7:
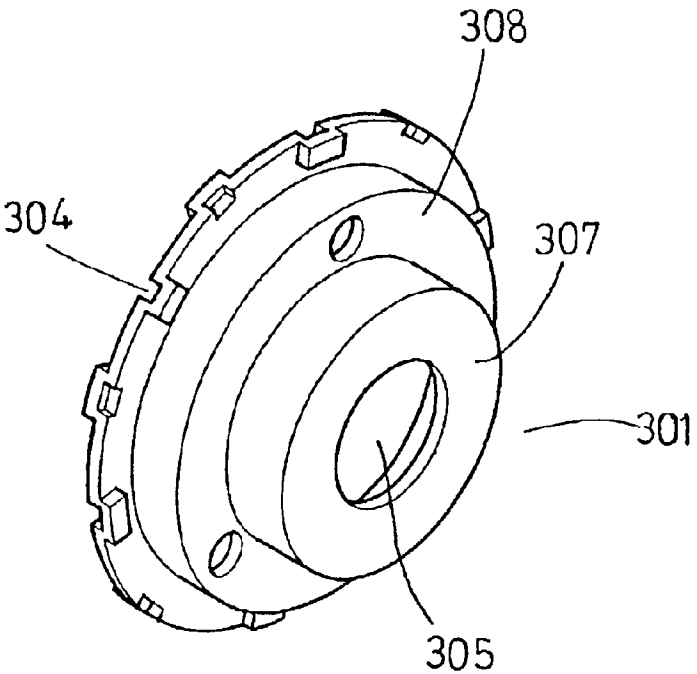
FIG. 7 is a perspective view of a casing, as seen from the opposite direction relative to that shown in FIG. 6.

As shown in FIGS. 4, 6, 7, a casing 301 is molded and secured in the center of the pulley 30 with such as a molding or mold injection process, and includes a space 306 formed therein for receiving the bearing 352, a peripheral fence 307 extended inward of the space 306 for forming an aperture 305 therein and for receiving the spindle 32. The casing 301 further includes a peripheral wall 308 extended radially outward from the middle portion for forming a chamber 309 therein and for receiving the peripheral plate 321 of the spindle 32. The casing 301 includes an outer peripheral portion having a number of recesses or extension 304 extended axially for solidly engaging or molding into the pulley 30. The pulley 30 may be made with metal or plastic or composite materials, and may include a peripheral flange 300 (FIG. 4) for engaging with the outer peripheral portion of the casing 301 and for solidly securing the casing 301 to the pulley 30.

A unidirectional bearing or driving device 31 is provided and engaged onto the peripheral plate 321 of the spindle 32, and engaged between the peripheral plate 321 and the casing 301. A cover 33 is engaged onto the unidirectional driving device 31, and includes a hole 331 formed therein for receiving the spindle 32. One or more fasteners 33 may be engaged through the cover 33 and the unidirectional driving device 31 and the casing 301 and may be threaded to the pulley 30 for solidly securing the unidirectional driving device 31 and the cover 33 to the casing 301 and the pulley 30. The bearing 351 is received in the cover 33. A pair of cranks and/or foot pedals 37 are secured to the non-circular cross ends 322 of the spindle 32 for rotating and driving the spindle 32 relative to the hub 36 and the pulley 30 and the unidirectional driving device 31.

Figure 8:
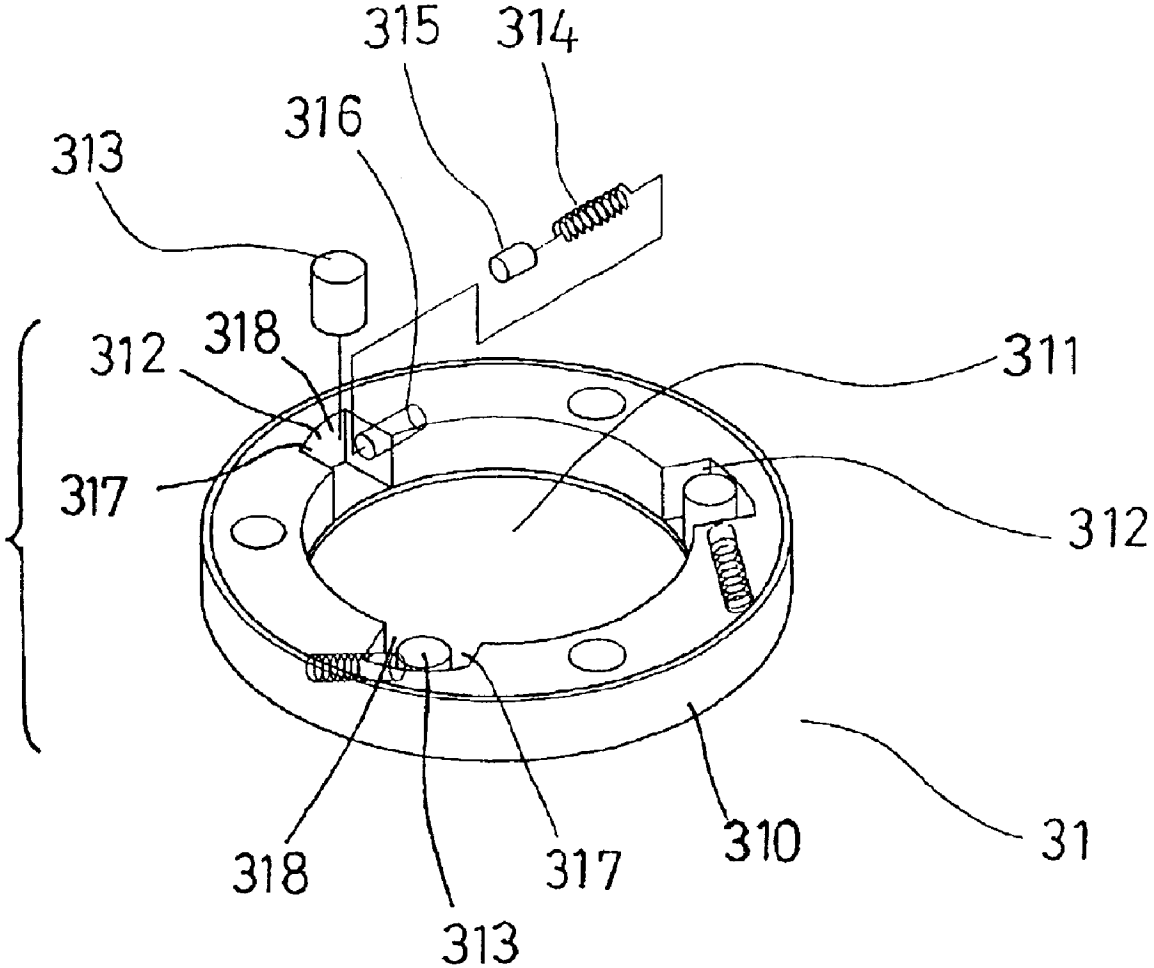
FIG. 8 is a partial exploded view of the unidirectional bearing or driving device of the exerciser.

As best shown in FIG. 8, the unidirectional driving device 31 includes a ring-shaped frame 310 a bore 311 formed therein for receiving the peripheral plate 321 of the spindle 32, and having one or more, such as three channels 312 formed therein and communicating with the bore 311 of the frame 310 for each receiving a ball or a roller 313 therein. The channels 312 of the frame 31 each includes a shallower end 317 having a depth smaller than the outer diameter of the rollers 313, and a deeper end 381 having a depth greater than the outer diameter of the rollers 313. The frame 310 further includes one or more, such as three blind holes 316 formed therein and communicating with the channels 312 thereof respectively for receiving a spring biased projection having a spring 314 and a pusher 315. The springs 314 may bias the pushers 315 to engage with the rollers 313 and to bias the rollers 313 toward the shallower end 317 of the channels 312 of the frame 310.

Figure 2:
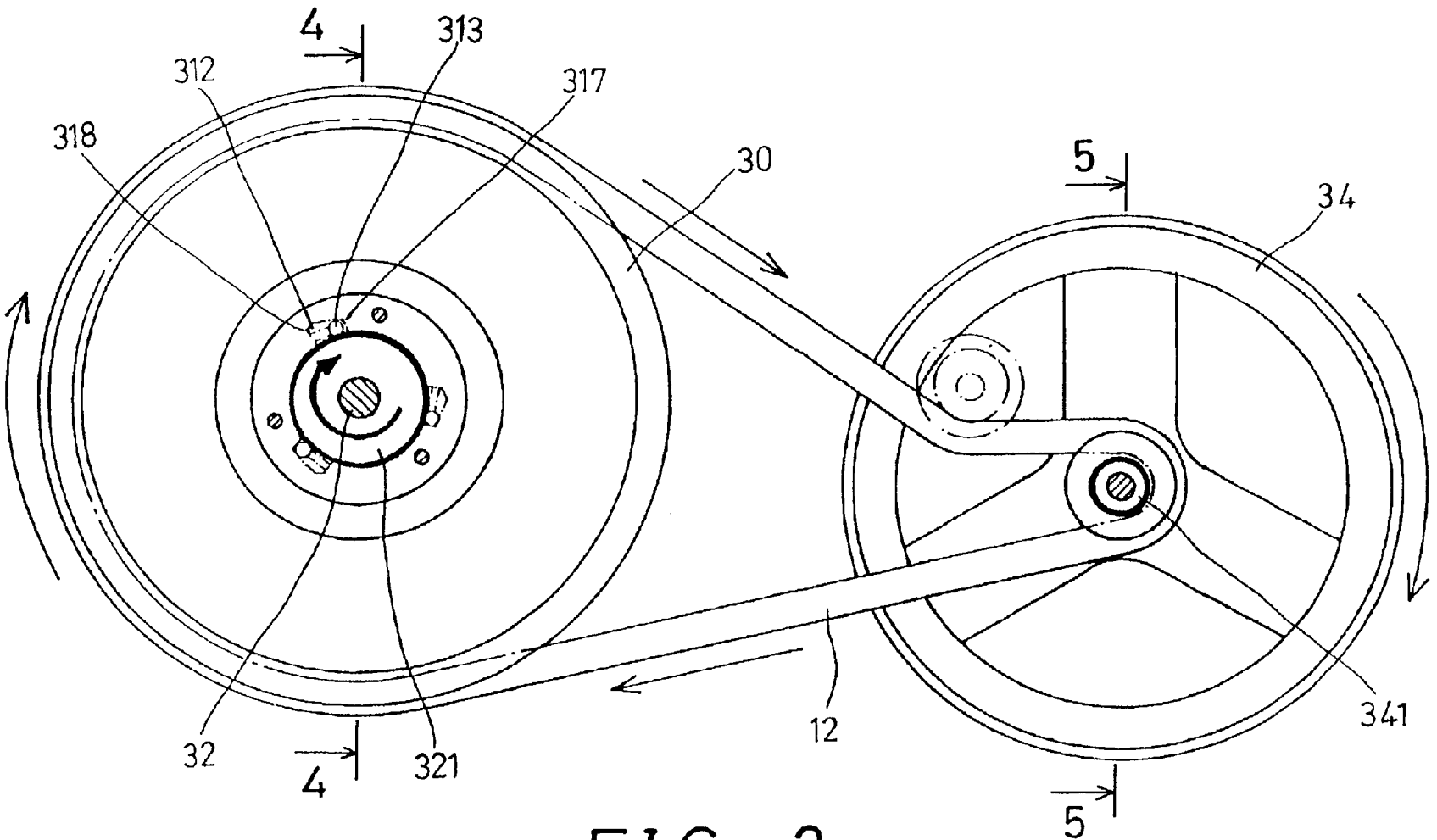
FIG. 2 is a partial plan view illustrating the driving mechanism of the exerciser.
Figure 3:
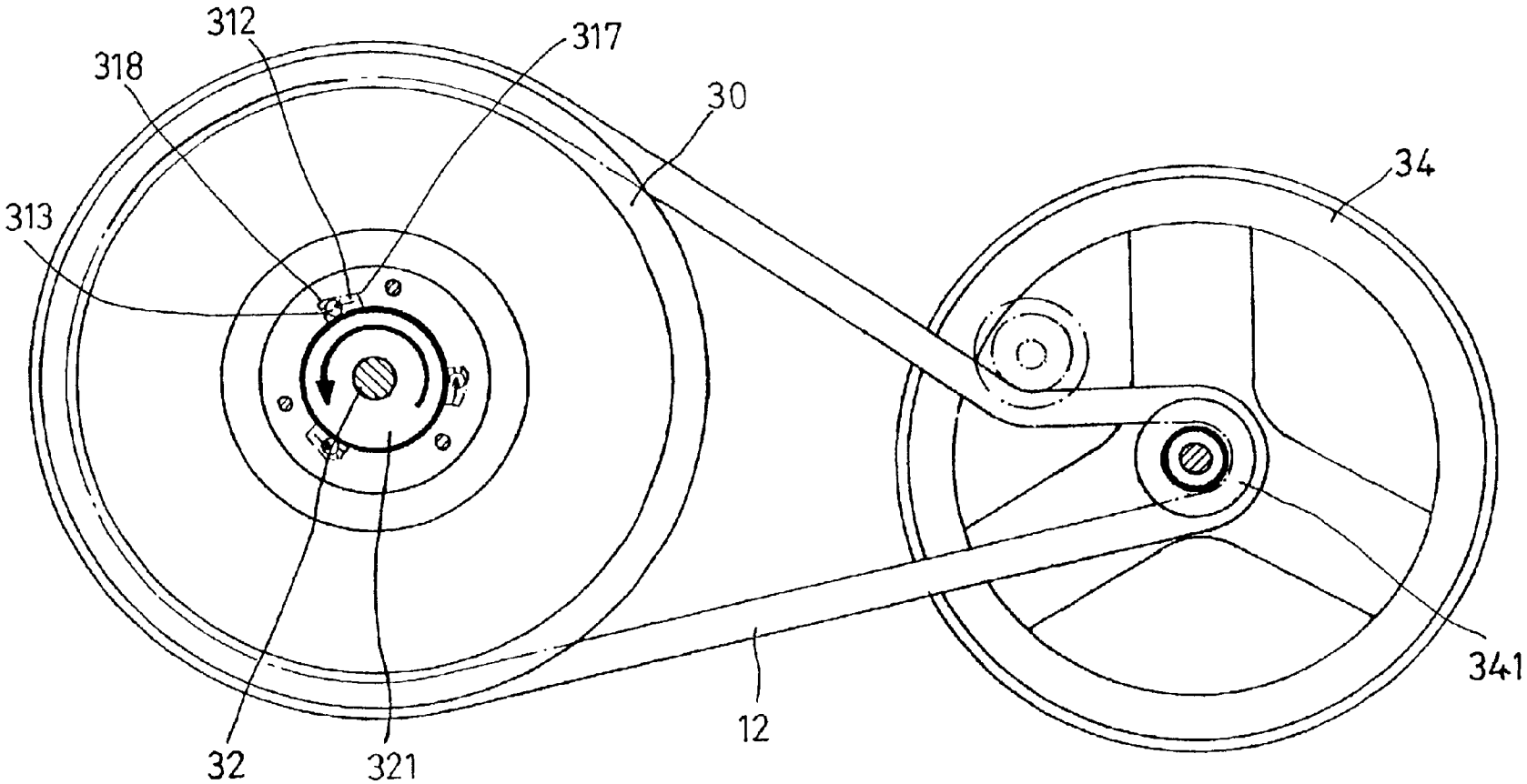
FIG. 3 is a partial plan view similar to FIG. 2, illustrating the operation of the driving mechanism of the exerciser.
Figure 5:
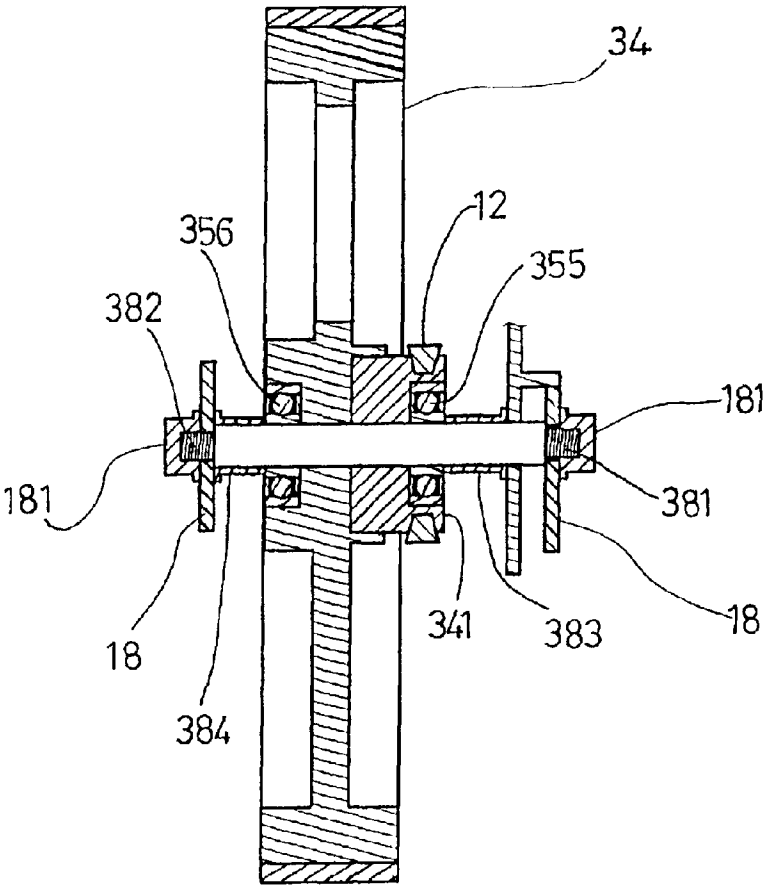
FIGS. 4, 5 are partial cross sectional views taken along lines 4—4 and 5—5 of FIG. 2 respectively.

In operation, as shown in FIG. 2, when the peripheral plate 321 and the spindle 32 is rotated or driven clockwise, for example, the rollers 313 may be caused to move toward the shallower end 317 of the channels 312 of the frame 310, for example, such that the rollers 313 may be clamped between the peripheral plate 321 and the frame 310 and such that the pulley 30 may also be rotated or driven clockwise. As shown in FIG. 3, when the peripheral plate 321 and the spindle 32 is rotated or driven counterclockwise, the rollers 313 may be caused to move toward the deeper end 318 of the channels 312 of the frame 310, such that the rollers 313 will not be clamped between the peripheral plate 321 and the frame 310 and such that the pulley 30 may not be rotated or driven counterclockwise by the spindle 32.

It is to be noted that the frame 310 of the unidirectional driving device 31 is engaged onto the peripheral plate 321 of the spindle 32, such that the frame 310 may include a greater inner diameter than the outer diameter of the spindle 32, for allowing the frame 310 and thus the pulley 30 may be solidly and effectively rotated and driven by the peripheral plate 321 of the spindle 32.

Accordingly, the exerciser in accordance with the present invention includes a solid driving structure for allowing the sprocket or the pulley to be solidly and effectively driven by the spindle via the unidirectional bearing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a hub provided therein, a spindle rotatably retained in said hub of said base, and including a peripheral plate extended radially outward therefrom, a rotary member rotatably engaged onto said spindle, a unidirectional driving device including a frame engaged between said peripheral plate and said rotary member, and said frame of said unidirectional driving device including a bore formed therein for receiving said peripheral plate of said spindle, and at least one channel formed therein and communicating with said bore of said frame and having a shallower end and a deeper end, a roller received in said at least one channel of said frame, a spring biased projection engaged in said frame and engaged with said roller for biasing said roller toward said shallower end of said at least one channel of said frame and for allowing said roller to be clamped between said frame and said peripheral plate of said spindle, and a pair of cranks coupled to said spindle for driving said rotary member unidirectionally with said unidirectional driving device.

2. The exerciser according to claim 1, wherein said rotary member includes a casing secured in a middle portion thereof and having an outer peripheral portion, said rotary member includes a peripheral flange extended therefrom for engaging with said outer peripheral portion of said casing and for solidly securing said casing to said rotary member.

3. The exerciser according to claim 2, wherein said casing includes a plurality of axially extended extension extended from said outer peripheral portion thereof for solidly engaging into said rotary member.

4. The exerciser according to claim 1 further comprising a wheel rotatably secured to said base with a shaft, and means for coupling said rotary member to said wheel.

5. An exerciser comprising:

a base including a hub provided therein, a spindle rotatably retained in said hub of said base, and including a peripheral plate extended radially outward therefrom, a rotary member rotatably engaged onto said spindle, a unidirectional driving device including a frame engaged between said peripheral plate and said rotary member, a pair of cranks coupled to said spindle for driving said rotary member unidirectionally with said unidirectional driving device, a wheel rotatably secured to said base with a shaft, and means for coupling said rotary member to said wheel, said coupling means including a first pulley provided on said wheel, said rotary member being a second pulley, and a belt engaged over said first pulley and said second pulley for allowing said wheel to be rotated and driven by said second pulley.

6. The exerciser according to claim 4 further comprising means for magnetically retarding said wheel to retard and brake said wheel.

* * * * *